US005893767A

United States Patent [19]

Broschard, III

[11] Patent Number: 5,893,767

[45] Date of Patent: Apr. 13, 1999

[54] ELECTRICAL CONNECTOR HAVING A SWITCH

[75] Inventor: John Lawrence Broschard, III, Hershey, Pa.

[73] Assignee: The Whitaker Corporation, Wilmington, Del.

[21] Appl. No.: 08/866,482

[22] Filed: May 30, 1997

[51] Int. Cl.[6] ..... H01R 29/00

[52] U.S. Cl. ..... 439/188; 439/668

[58] Field of Search ..... 439/188, 607, 439/608, 609, 610, 668, 669; 200/51.09, 51.1

[56] References Cited

U.S. PATENT DOCUMENTS

| | | | |
|---|---|---|---|
| Re. 35,039 | 9/1995 | Masuda et al. | 29/876 |
| 3,166,649 | 1/1965 | Frantz et al. | 200/51.1 |
| 4,633,048 | 12/1986 | Komatsu | 200/51.1 |
| 5,290,179 | 3/1994 | Weingartner | 439/669 |
| 5,338,215 | 8/1994 | Lee et al. | 439/188 |
| 5,693,924 | 12/1997 | Fetterolf, Sr. et al. | 200/51.1 |

FOREIGN PATENT DOCUMENTS 6901473 6/1969 Germany .

OTHER PUBLICATIONS

Attorney Docket No. 16190; Patent Application Serial No. 08/495,143; Filed Jun. 28, 1995; Abstract and Drawings.

Attorney Docket No. 16190A; Patent Application Serial No. 08/615,905; Filed Mar. 14, 1996; Abstract and Drawings.

AMP Incorporated Product Drawing C-11130 (1995) Audio Jack Etc. 1 page.

AMP Incorporated Product Drawing C-787905 (Rev 0 Oct. 28, 1996) 1 page.

Hosiden Electronics Co., Ltd. Product Drawing "Jack" Revision Date Dec. 27, 1991 Approved Aug. 24, 1992 (2 Sheets).

*Primary Examiner*—Neil Abrams
*Assistant Examiner*—Brian J. Biggi
*Attorney, Agent, or Firm*—Katherine A. Nelson

[57] ABSTRACT

Connector (20) includes switches (32,132) each having a movable switching terminal (34,134) with a spring arm (40,140) engaged by a stationary terminal (54,154) at a switch point when the connector is unmated. Upon connector mating, switching terminal (34,134) is deflected by the mating connector (90) out of engagement with the stationary terminal thereby disrupting a circuit therebetween. The stationary terminal (54,154) engages the switching terminal (34,134) by means of a spring arm (60,160) biased against the switching terminal when the connectors are unmated, resulting in a wiping action when the switching terminal is being deflected away therefrom or resiling thereagainst, during connector mating and unmating respectively.

4 Claims, 4 Drawing Sheets

ELECTRICAL CONNECTOR HAVING A SWITCH

FIELD OF THE INVENTION

This invention is directed to electrical connectors and more particularly to electrical connectors having at least one switch therein.

BACKGROUND OF THE INVENTION

Electronic devices and connectors such as, for example, audio jacks and like include at least one switch having two terminals that are electrically engaged at a switch point. One such example of a switching jack connector is disclosed in U.S. Pat. No. 4,633,048 in which one of the terminals is a fixed terminal and the other terminal is a movable terminal that can be moved from electrical engagement with the fixed terminal within the connector to engagement with a mating plug upon inserting the plug into the connector housing. When switching connectors are repeatedly mated and unmated, there is a chance that there will be oxide buildup that will prevent effective electrical connection of the switch after a period of time. It is desirable, therefore, that there be some inherent means for removing any oxide buildup to assure good electrical connection when the plug is removed from the connector.

SUMMARY OF THE INVENTION

The present invention is directed to an electrical connector having a switch that provides wiping between the two terminals at a switch point when the switch is opened or closed. A movable or switching terminal includes a spring arm having an engagable portion therealong between a fulcrum and leading end of the spring arm. The spring arm is adapted to be electrically engaged by a terminal engaging section of a stationary terminal thereby defining the switch point. The switching terminal is disconnected from the stationary terminal at the switch point by a plug inserted into the connector. The switching terminal then becomes electrically engaged to a corresponding terminal of a matable plug connector upon receipt of the plug terminal into a plug receiving cavity upon connector mating. To provide a wiping action the stationary in terminal includes a resilient arm having a terminal engaging section proximate the free end thereof. The terminal engaging section is spring biased against the engagable portion of the switching terminal. The terminal engaging surface of the stationary terminal slides along the engagable portion of the switching terminal at least a slight distance both prior to disengagement as the stationary terminal spring resiles toward the switching terminal. The same type of movement also occurs in an opposite direction when the connector is unmated and the spring arm of the stationary terminal is deflected by the switching terminal. This movement wipes away any oxide buildup at the switch point, and also wipes away other contaminants that may have entered the connector.

For purposes of illustration, the improved switch of the present invention will be described with relation to an audio jack. The audio jack, as shown herein, includes two switches, one for each of two speakers. The plug is used to connect to ear phones, or the like. It is to be understood that the switch of the present invention may be used with other electrical devices as well.

An embodiment of the invention will now be described by way of illustration with reference to the following drawings.

DETAILED DESCRIPTION OF AN EMBODIMENT OF THE INVENTION

Figure 1:
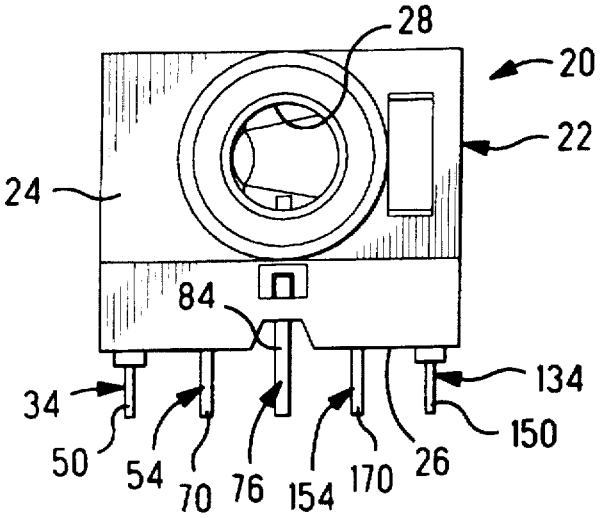
FIG. 1 is a plan view of the front of an audio jack made in accordance with the present invention.

Referring now to FIGS. 1 through 7, audio jack 20 includes a insulated body 22, two switches 32, 132 and a ground terminal 76. Insulative body 22 includes a forward section 21 and a rear cover 23. Forward section has a front face 24, a lower face 26 and a plug receiving receptacle or cavity 28 extending into the housing 22 from front face 24 thereof.

For purposes of illustration the invention is being described with reference to an audio jack having two switches, one for each of two speakers and a ground terminal. The plug used with this audio jack includes two signal contacts, one at the tip and one spaced from the tip and a ground contact for mating with the corresponding terminals in the jack. It is to be understood that the switching terminals of the present invention may also be used in other electronic devices.

Figure 2:
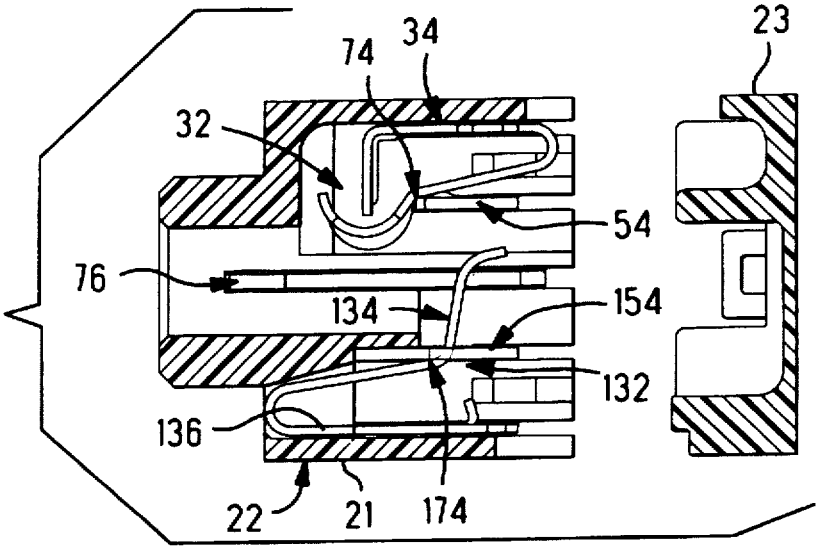
FIG. 2 is sectional view of the audio jack of FIG. 1 illustrating the terminals therein.
Figure 3:
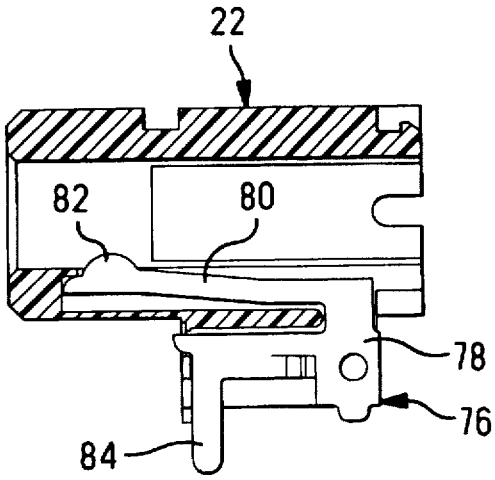
FIG. 3 is a sectional view of the jack of FIG. 1 showing the ground terminal therein.

The position of the two switches 32, 132 and the ground terminal 76 in the housing 22 is best understood by referring to FIGS. 2 and 3. As shown in FIG. 2, switches 32 and 132 are substantially on opposite sides of the ground terminal 76, which extends along the lower housing surface. Switch 32 includes a switching terminal 34 and a stationary terminal 54. Switch 132 includes a switching terminal 134, and 154.

Switching terminal 34 of switch 32 includes a body 36 having a spring arm 40 with an engagable portion 42 extending between the fulcrum 44 and the leading end 46. Engagable portion 42 is adapted to be electrically engaged by a cooperating terminal engaging section 62 of the stationary terminal 54. Switching terminal 34 further includes a contact surface 48 at the leading end 46 thereof for engaging a signal contact 94 of a plug 90, as more fully explained below. Switching terminal 34 is disposed in a housing passageway and is retained in by retention features (not shown) on the body 36. Switching terminal 34 includes a board connecting portion 50 extending outwardly from the housing 22.

Figure 7:
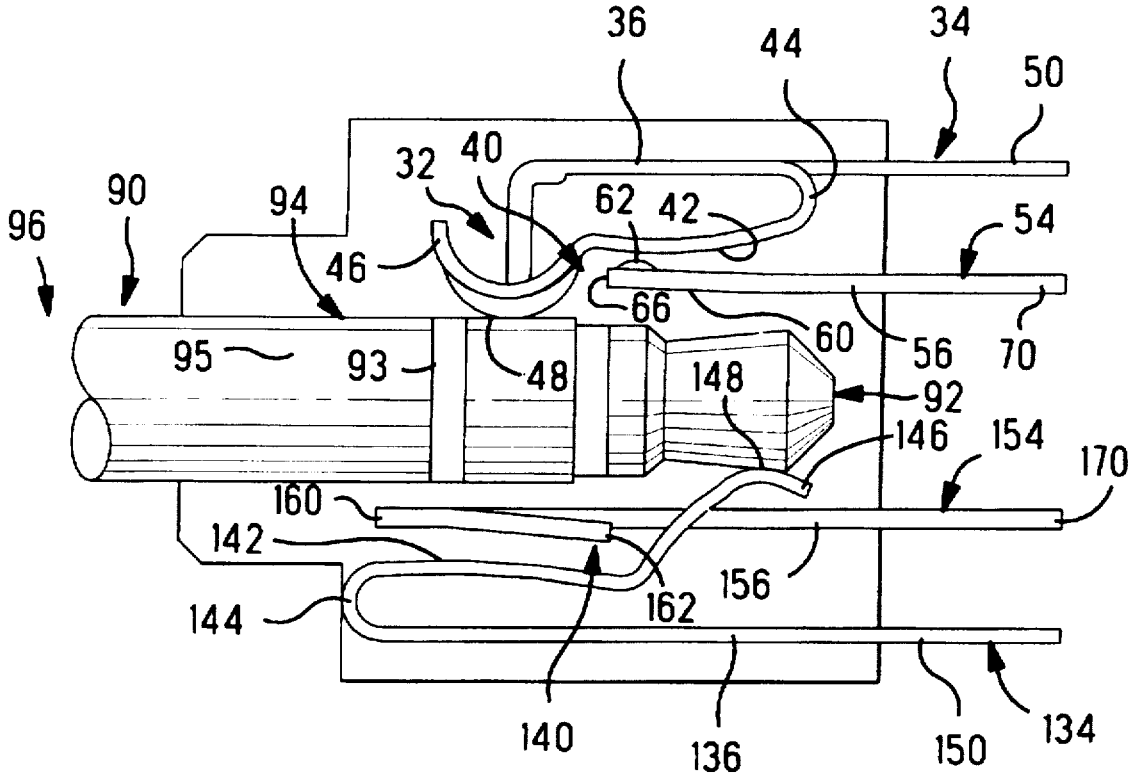
FIG. 7 is a view similar to that of FIG. 5 illustrating the position of the terminals when the plug has been fully inserted into the audio jack.

Stationary terminal 54 includes a body 56 having a resilient arm 60 with a terminal engaging section 62 at the leading end 66 thereof, and a board engaging portion 70 extending outwardly from the housing. Terminal 54 is disposed in a housing passageway and is held therein by retaining portions (not shown) on the body 56. As best seen in FIG. 7, the resilient arm 60 of terminal 54 extends upwardly at a slight angle from body 56 when terminal 54 is in its unmated position, that is when the plug is fully inserted into the jack. When arm 60 is electrically engaged by switching terminal 34, the arm is deflected downwardly and is spring biased against engagable portion 42 of switching terminal 34.

Ground terminal 76 includes a body 78 having a arm 80 with a contact surface 82 thereon for engaging corresponding ground conductor 96 of the plug 90 and a board mounting section 84 extending outwardly from the housing 22.

Switch 132 includes a switching terminal 134 having a body 136 having a spring arm 140 with an engagable portion 142 extending between the fulcrum 144 and the leading end 146. Engagable portion 142 is adapted to be electrically engaged by a cooperating terminal engaging section 162 of the stationary terminal 154. Switching terminal 134 further includes a contact surface 148 at the leading end 146 thereof for engaging a signal contact 92 of a plug 90, as more fully explained below. Switching terminal 134 is disposed in a housing passageway and is retained in by retention features (not shown) on the body 136. Switching terminal 134 includes a board connecting portion 150 extending outwardly from the housing 22.

The stationary terminal 154 of switch 132 includes a body 156 having a resilient arm 160 with a terminal engaging section 162 at the leading end 166 thereof, and a board engaging portion 170 extending outwardly from the housing 22. Terminal 154 is disposed in a housing passageway and is held therein by retaining portions (not shown) on the body 156. As best seen in FIG. 7, the resilient arm 160 of terminal 154 extends downwardly at a slight angle from body 156 when terminal 154 is in its unmated position, that is when the plug is fully inserted into the jack. When arm 160 is electrically engaged by switching terminal 34, the arm is deflected upwardly and is spring biased against engagable portion 142 of switching terminal 134.

Plug 90 includes two signal contacts 92, 94 that are electrically isolated from each other at 93 and a ground contact 96, electrically isolated at 95 from signal contact 94 and is typical of plugs known in the art.

Figure 4:
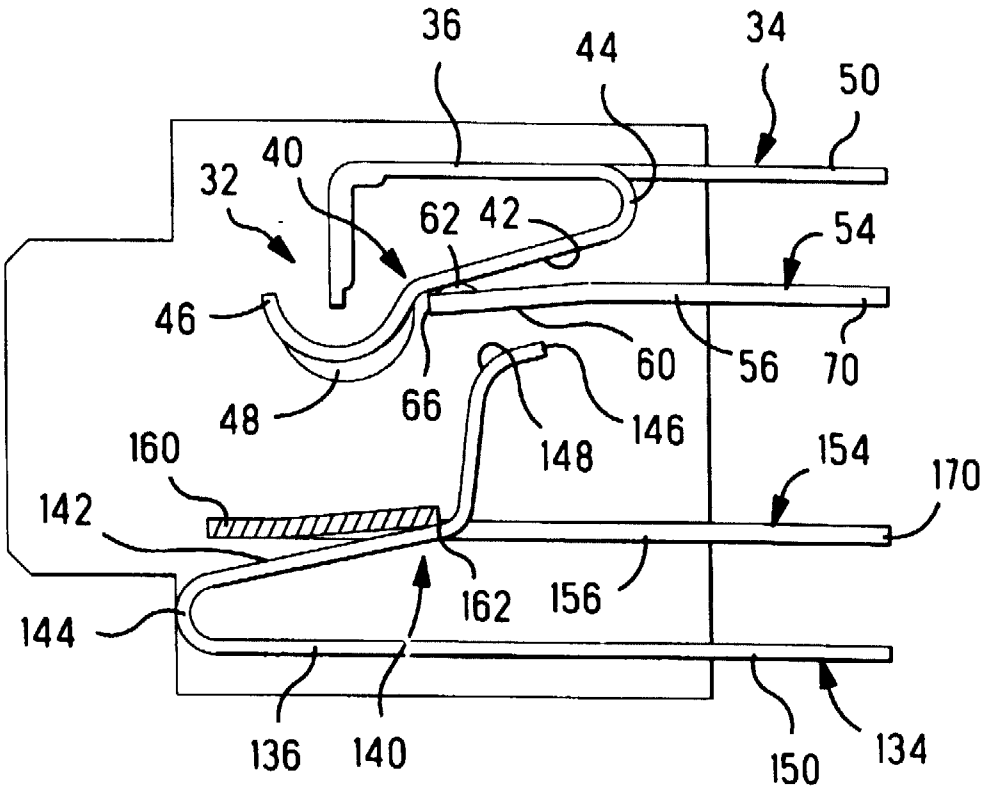
FIG. 4 is a schematic view of the jack of FIG. 1 illustrating the positions of the two switches contained therein, prior to insertion of the plug.
Figure 4:
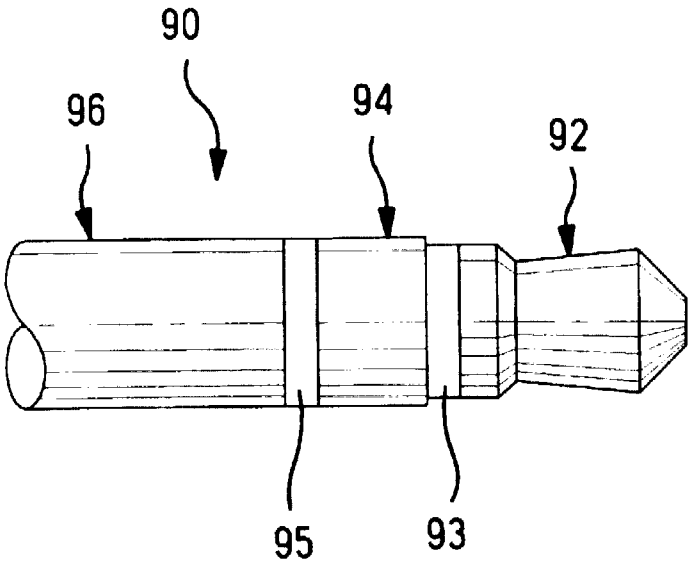
Figure 5:
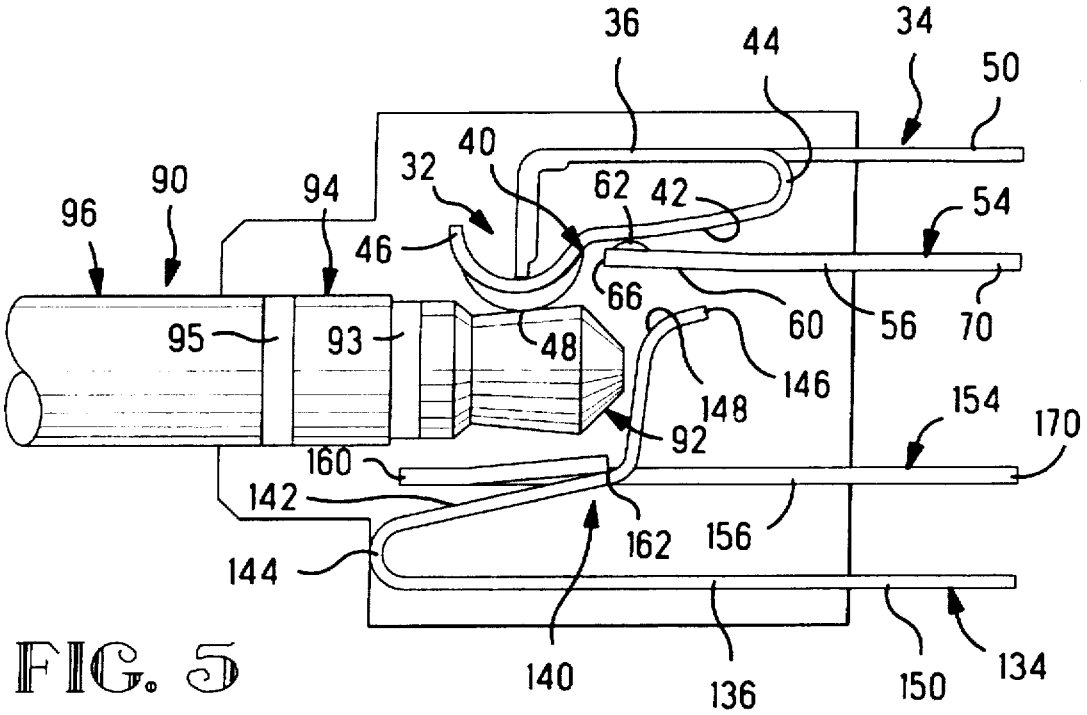
FIG. 5 is a view similar to that of FIG. 4 illustrating the position of the terminals as the plug is partially inserted into the jack.
Figure 6:
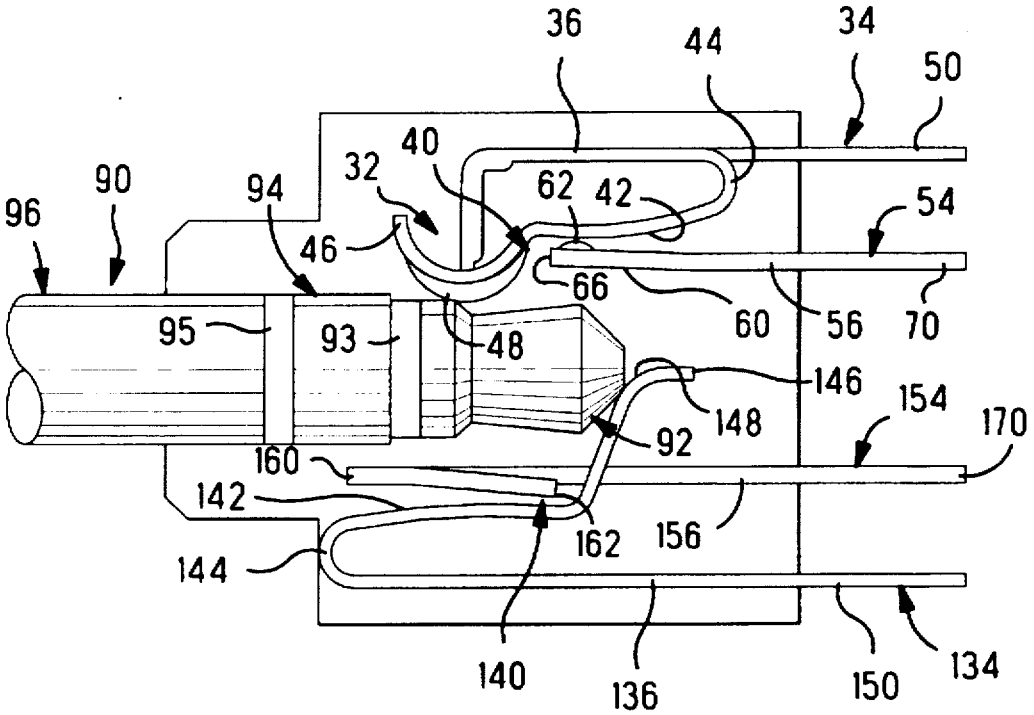
FIG. 6 is a view similar to that of FIG. 5 illustrating the position of the terminals as the plug is further inserted into the jack.

The operation of the switches 32, 132 is best understood by referring to FIGS. 4 through 7, which pictorially show the sequential mating of the plug 90 with the switching terminals 34, 134. For purposes of illustration the housing structure has been eliminated from the figures and the board engaging sections have not been profiled or formed to define right angles with respect to the housing. The mating sequence will be described first with reference to switch 32. It is to be understood the same mating sequence is simultaneously occurring with switch 132. As best seen in FIG. 4 prior to inserting plug 90 into the plug receiving receptacle 28 of jack 20, the terminal engaging section 62 on the resilient arm 60 of the stationary terminal 54 is electrically engaged under spring bias with the engagable portion 42 of switching terminal 34. As the plug 90 is inserted into the jack receptacle 28, the leading end of the plug 90 engages the contact surface 48 at the leading end 46 of the switching terminal 34 and the deflecting the spring arm 38 upwardly as the plug 90 enters the receptacle 28. As plug 90 moves further into the cavity the spring arm 38 is further deflected upwardly until the plug 90 is fully inserted and the contact surface 48 of spring arm 40 engages the signal contact 94 of the plug. As the sequence of mating proceeds, the resilient arm 60 of the stationary terminal 54 moves along the engagable portion 42 and resiles upwardly following the engagable portion 42 until the plug 90 is almost fully inserted at which time the stationary terminal 54 is no longer spring biased against the engagable portion 42 of the switching terminal 34. The switch 32 in the jack is now open and contact surface 48 Of the switching terminal 34 is engaged to a signal contact 94 of the plug, as shown in FIG. 7.

As the plug 90 is inserted into the plug receiving receptacle 28, the leading end 92 of the plug also engages the contact surface 148 of switching terminal 134 deflecting the spring arm 140 downwardly such that the corresponding engagable section 162 of stationary terminal 154 is moved along the engagable portion 142 of switching terminal 134 as the plug is moved into the receptacle 28. Upon full insertion, as shown in FIG. 7, both switches 32, 132 are disengaged at the switch points 74, 174 and the corresponding switching terminals 34, 134 are engaged to respective signal contacts 92, 94 of the plug 90. The ground terminal 76 also is engaged with the ground conductor 96 of the plug (not shown).

The movement of the respective terminal engaging sections 62, 162 of the stationary terminals 54, 154 as the respective switching terminals 34, 134 engage the plug causes a wiping action along the engagable arm portions 42, 142 to wipe away any oxide buildup. This wiping also occurs upon removal of the plug as the switching terminals 34, 134 are moved into their original positions and the respective engagable portions 42, 142 engage corresponding terminal engaging sections 62, 162 of the respective stationary terminals 54, 154 at the switch points 74, 174. The wiping action removes any oxide buildup between the respective switching terminals 34, 134 and the stationary terminals 54, 154, thus assuring good electrical connection between the respective switches 32, 132 at the switch points 74, 174.

It is thought that the switches of the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector having a plug receiving cavity and at least a first switch having two terminals electrically engaged at a switch point, one of said terminals being a switching terminal and the other of said terminals being a stationary terminal, said switching terminal including a spring arm having an engagable portion therealong between a fulcrum of the spring arm and a leading end thereof adapted to be electrically engaged by a terminal engaging section of said stationary terminal defining said switch point, said switching terminal being adapted to be disconnected from said stationary terminal at said switch point upon becoming electrically engaged to a corresponding terminal of a matable plug connection upon receipt of said corresponding plug terminal into said plug receiving cavity during connector mating; the connector being characterized in that:

said stationary terminal includes a resilient arm having said terminal engaging section proximate free end thereof, said resilient arm being deflected by said switching terminal such that said terminal engaging section is spring biased against said engagable portion of said switching terminal prior to mating of said plug terminal, whereby said terminal engaging section slides along said engaged portion of said switching terminal at least a slight distance both prior to disengagement as said stationary terminal resilient arm resiles toward said switching terminal, and also after re-engagement therebetween during connector unmating as said spring arm becomes re-deflected by said switching terminal, thereby wiping away oxide buildup.

2. The connector as set forth in claim 1 wherein said terminal engaging section of said stationary terminal is defined on a convex embossment extending toward said switching terminal.

3. The connector as set forth in claim 1, further including a second said switch having a said stationary terminal and a said switching terminal.

4. The connector as set forth in claim 3 wherein said connector is an audio jack matable with a plug connector having a pair of signal contacts engagable with respective ones of said switching terminals of said first and second switches during connector mating.

* * * * *